US006491610B1

(12) United States Patent
Henn

(10) Patent No.: US 6,491,610 B1
(45) Date of Patent: Dec. 10, 2002

(54) MULTI-PURPOSE EXERCISE BENCH

(76) Inventor: Dale R. Henn, 5605 Elliot Ave. South, Minneapolis, MN (US) 55417

( * ) Notice: Subject to any disclaimer, the term of this patent is extended or adjusted under 35 U.S.C. 154(b) by 0 days.

(21) Appl. No.: 09/549,314

(22) Filed: Apr. 13, 2000

Related U.S. Application Data

(60) Provisional application No. 60/129,088, filed on Apr. 13, 1999.

(51) Int. Cl.[7] ..... A63B 21/00

(52) U.S. Cl. ..... 482/130; 482/137; 482/95; 482/96

(58) Field of Search ..... 482/137, 95, 96, 482/102, 103, 133, 99, 100, 101; D21/662, 673, 690

(56) References Cited

U.S. PATENT DOCUMENTS 4,988,095 A * 1/1991 Ferrari ..... 482/102
5,362,296 A * 11/1994 Wang et al. ..... 482/133
6,102,836 A * 8/2000 Person ..... 482/103

* cited by examiner

*Primary Examiner*—Jerome Donnelly

(57) ABSTRACT

An exercise bench includes a floor engaging base, a vertical column, a body support, and inclined rails which occupy a vertical plane together with the column. Cables are interconnected between respective handles and respective pivot arms. At least one resistance device is interconnected between the pivot arms and one of the frame members. The cables are routed about pulleys which are selectively movable along respective rails to facilitate different types of exercise motions.

40 Claims, 6 Drawing Sheets

MULTI-PURPOSE EXERCISE BENCH

This application claims the benefit of provisional application 60/129,088 filed on Apr. 13, 1999.

FIELD OF THE INVENTION

The present invention relates to exercise equipment and especially to a multi-purpose exercise bench.

BACKGROUND OF THE INVENTION

Many types and variations of exercise equipment are known in the art. The "home gym" is one recognized exercise equipment category. Generally speaking, this type of product is intended to provide a variety of exercises on a single piece of equipment which is relatively compact and affordable.

SUMMARY OF THE INVENTION

The present invention provides a multi-purpose exercise bench which strikes a desirable balance between the cost of manufacture and both the quantity and quality of available exercises. Many of the features and/or advantages of the present invention will become apparent to those skilled in the art from the more detailed description that follows.

BRIEF DESCRIPTION OF THE FIGURES OF THE DRAWING

With reference to the Figures of the Drawing, wherein like numerals represent like parts and assemblies throughout the several views.

DETAILED DESCRIPTION OF A PREFERRED EMBODIMENT

Figure 1:
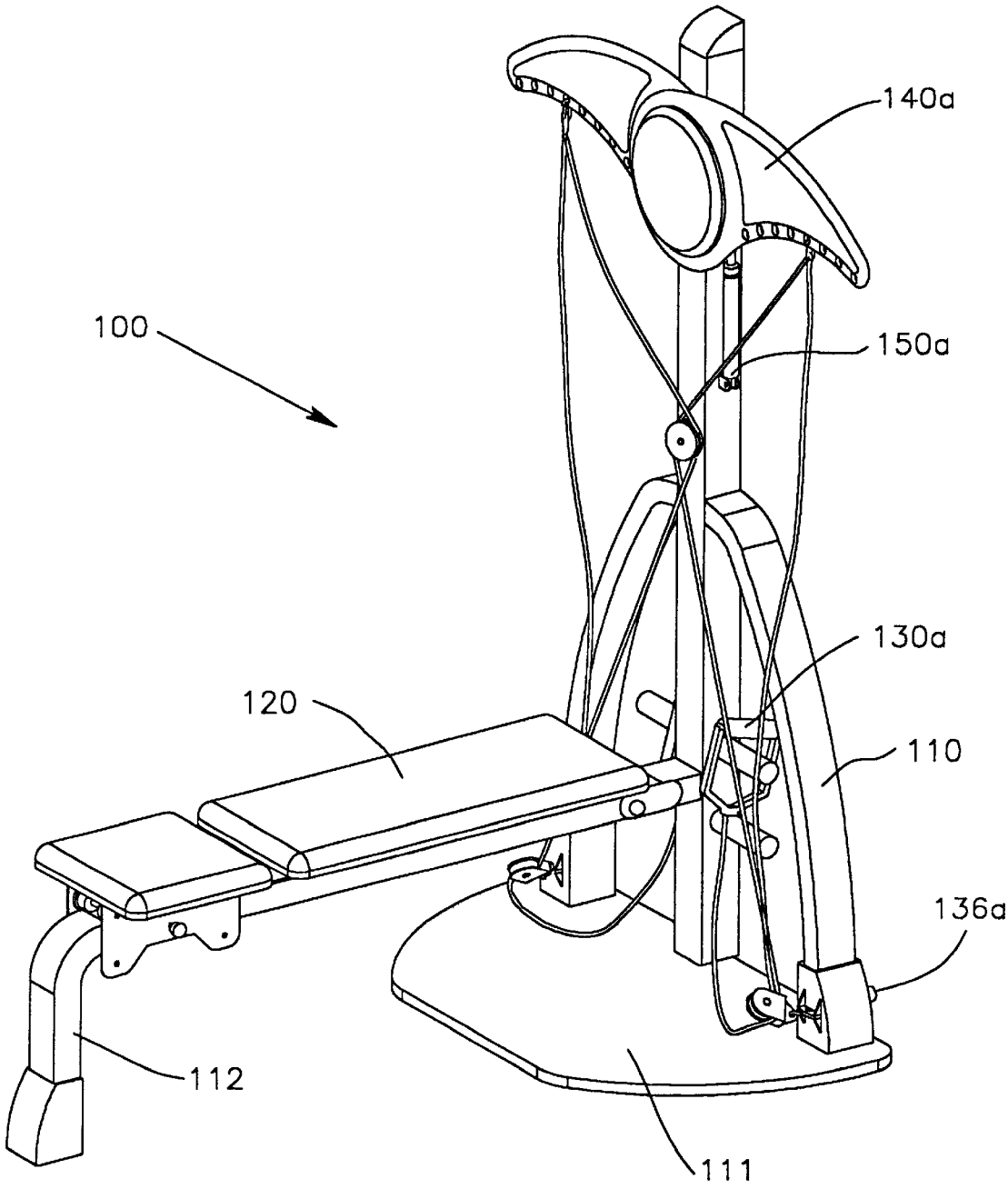
FIG. 1 is a perspective view of an exercise bench constructed according to the principles of the present invention.

The present invention is described herein with reference to a preferred embodiment exercise apparatus designated as 100 in FIGS. 1–6. The apparatus 100 generally includes a frame 110, a body support 120, force receiving members 130*a–b*, force transmission members 140*a–b*, and force resistance members 150*a–b*.

The frame 110 includes a floor engaging platform or base 111 and a vertical stanchion 114 extending perpendicularly upward from the platform 111. Left and right rails 113*a* and 113*b* extend upward from opposite sides of the platform 111 and toward an intermediate portion of the stanchion 114. The rails 113*a* and 113*b* cooperate to define a generally parabolic shape and may be described as inclined relative to the underlying floor surface. A central, L-shaped rail 112 extends perpendicularly away from the stanchion 114, between the platform 111 and the tops of the rails 113*a* and 113*b*, and then downward into engagement with an underlying floor surface. The rail 112 is releasably secured to the stanchion 114 be means of a fastener 118 extending through the rail 112 and a support extending outward from the stanchion 114.

Figure 5:
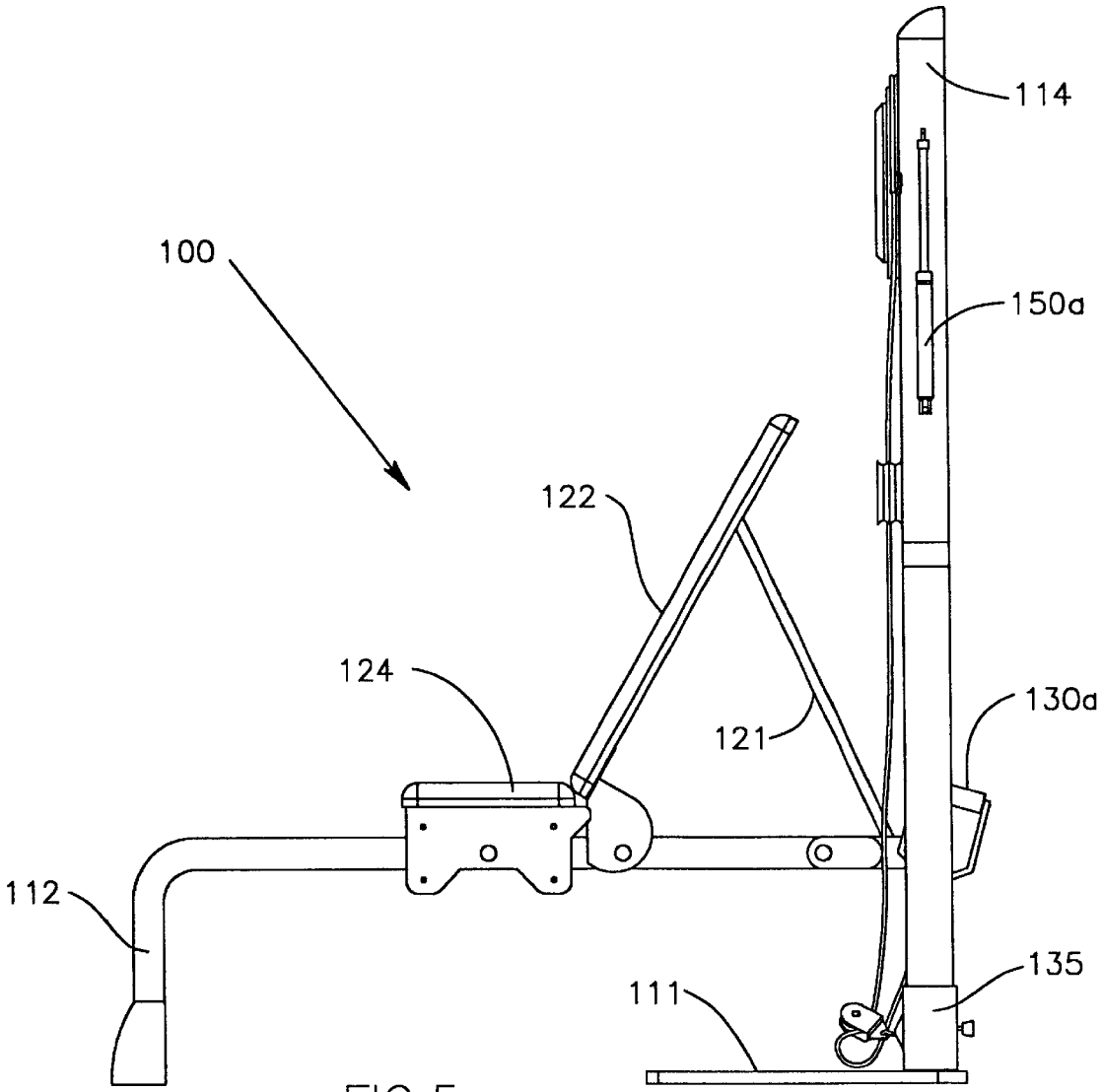
FIG. 5 is a side view of the bench of FIG. 1 in a second configuration.

The body support 120 includes a back supporting member 122 which is mounted on the rail 112 and selectively movable relative thereto. A detent pin 123 or other suitable fastener selectively secures the back supporting member 122 in place relative to the rail 112. As shown in FIG. 5, a brace 121 is pivotally mounted on the back supporting member 122 and folds from underneath same to selectively support the back supporting member 122 in an inclined orientation relative to the rail 112.

Figure 6:
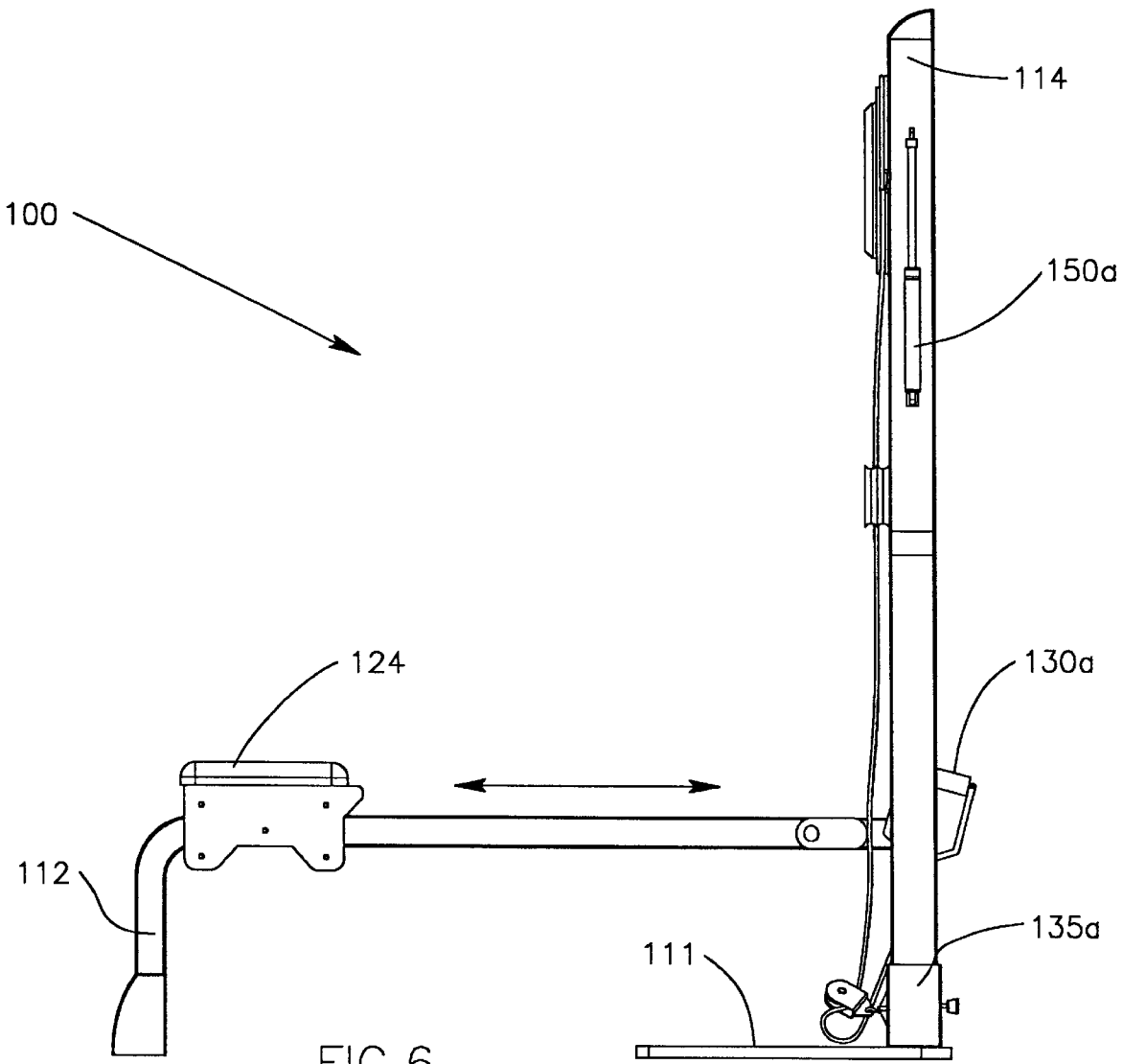
FIG. 6 is a side view of the bench of FIG. 1 in a third configuration.

The body support 120 also includes a seat 124 which is mounted on the rail 112 and selectively movable relative thereto. In particular, rollers are rotatably mounted on the seat 123 and bear against the rail 112. A detent pin 125 or other suitable fastener is inserted through aligned holes in the seat 124 and the rail 112 in order to selectively secure the former in place relative to the latter. As shown in FIG. 6, the back supporting member 122 may be removed from the rail 112 to permit travel of the seat 124 back and forth along the rail 112 (as suggested by the arrows).

Figure 2:
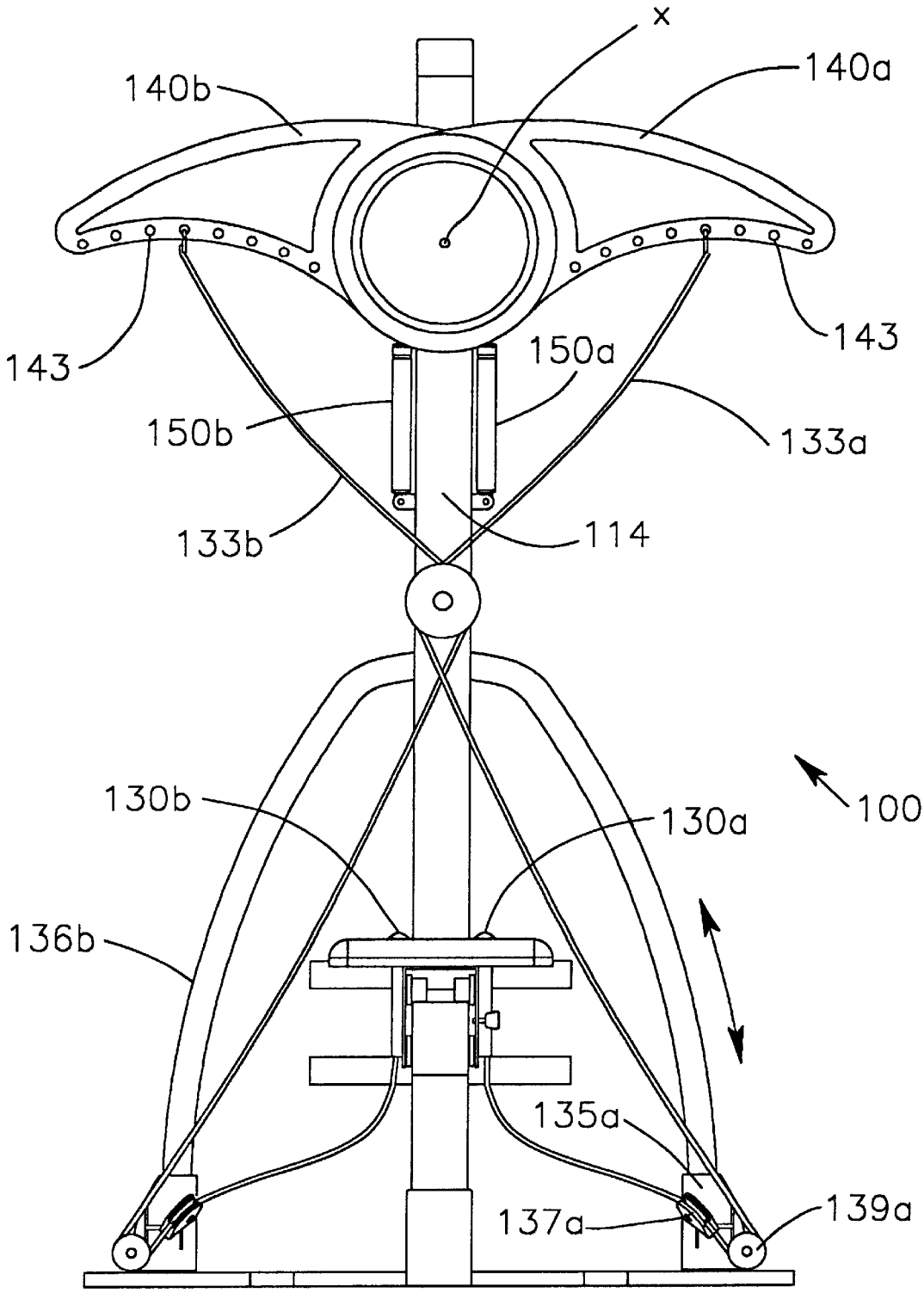
FIG. 2 is a front view of the bench of FIG. 1.
Figure 3:
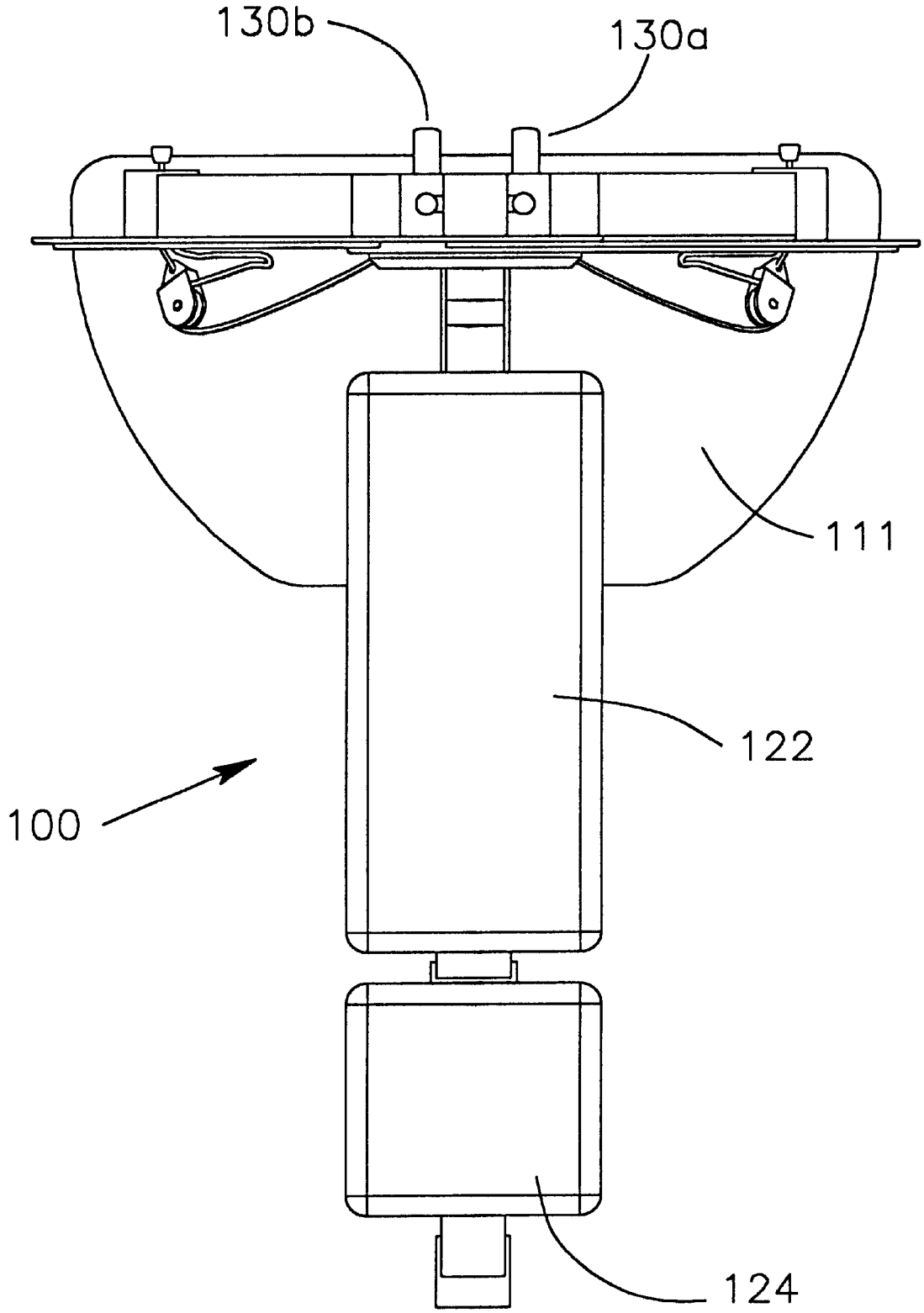
FIG. 3 is a top view of the bench of FIG. 1.
Figure 4:
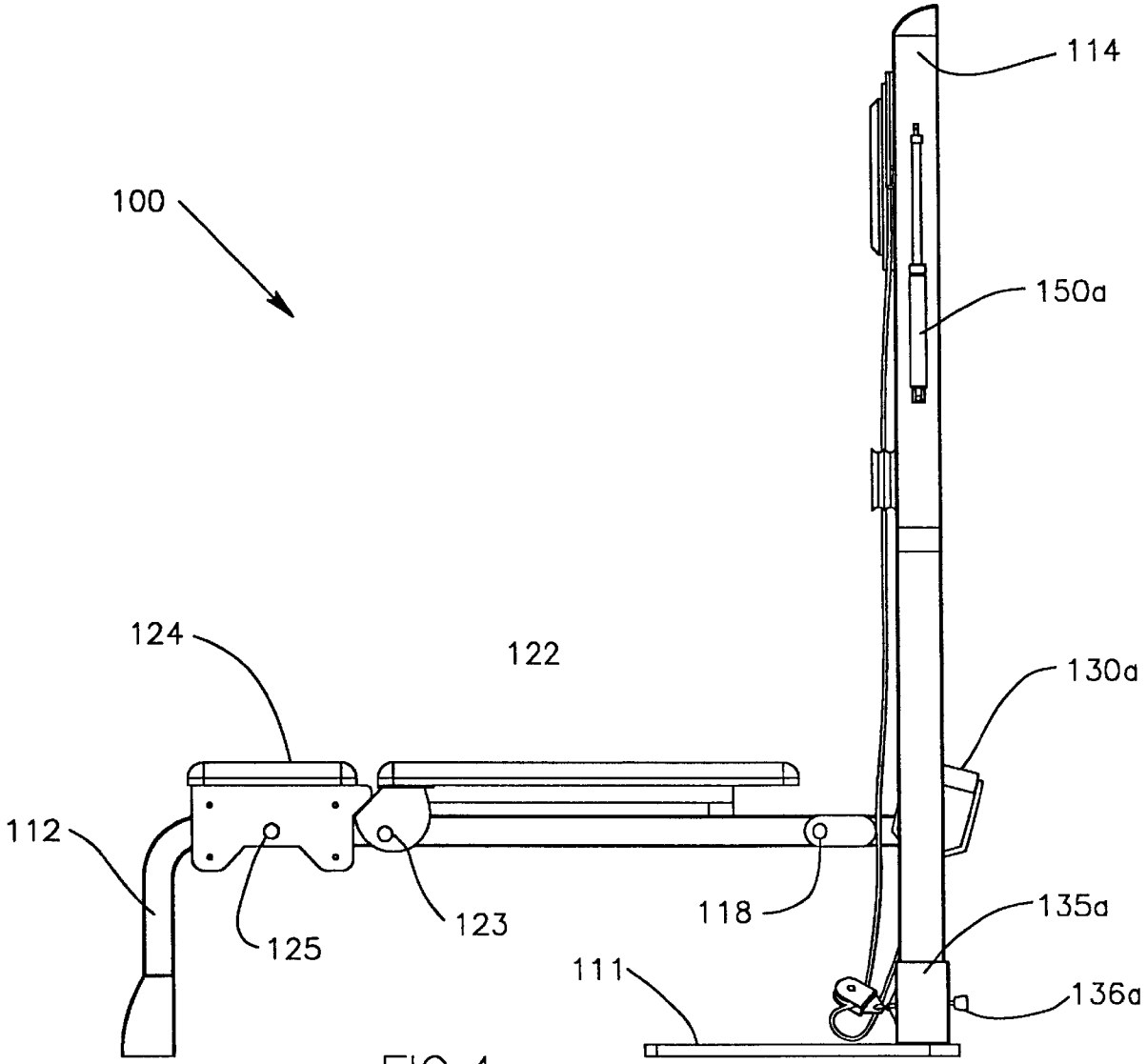
FIG. 4 is a side view of the bench of FIG. 1.

FIG. 2 shows a preferred way to connect the force receiving members 130*a* and 130*b* to the force transmitting members 140*a* and 140*b*. With respect to the right side of the apparatus 100, for example, a bracket 135*a* is mounted on the rail 113*a* and selectively movable relative thereto (as suggested by the arrows). A detent pin 136*a* (shown in FIGS. 1 and 4) or other suitable fastener inserts through any of several holes in the rear side of the rail 113*a* to selectively secure the bracket 135*a* in any of several positions along the rail 113*a*. A first pulley 137*a* or other suitable guide is mounted on the bracket 135*a*. A second pulley 139*a* or other suitable guide is mounted on the frame 110 on or near the platform 114. A flexible cable 133*a* is connected to the force receiving member 130*a*, and then routed sequentially about the pulley 137*a* and the pulley 139*a*.

The pulley 137*a* may be relocated along the rail 113*a* to vary the type and/or difficulty of exercise, while the pulley 139*a* remains fixed and thereby allows the force receiving member 130*a* to remain in a similar starting position regardless of the location of the pulley 137*a*. For example, when the pulleys 137*a* and 137*b* are positioned proximate the floor, the apparatus 100 is configured for providing a "dead lift" exercise. At the other extreme, the pulleys 137*a* and 137*b* may be moved near the upper ends of respective rails 113*a* and 113*b* to facilitate a rowing exercise (with the apparatus 100 adjusted to the configuration shown in FIG. 6).

An opposite end of the cable 133*a* is routed about a pulley 103*a* on the stanchion 114 and then connected to the force transmitting member 140*a* via any of several holes 143 provided in same. The force transmitting member 140*a* is mounted on the stanchion 114 and rotatable relative thereto about a rotational axis X. A fluid cylinder 150*a* or other suitable resistance mechanism is movably interconnected between the force transmitting member 140*a* and the stanchion 114 to resist rotation of the former relative to the latter. On this embodiment 100, the cylinder 150*a* is configured to change length subject to a constant resistance force. Resistance to exercise is adjusted by relocating the cable 133*a* along the force transmitting member 140*a*, recognizing that the user's mechanical advantage increases as a function of distance from the axis of rotation X.

The foregoing description and accompanying figures disclose only a preferred embodiment and/or application of the present invention. However, this disclosure will enable those skilled in the art to derive additional embodiments and/or variations. For example, different types of known resistance devices may be substituted for the cylinders 150*a* and 150*b* without departing from the scope of the present invention. Therefore, the scope of the present invention should not be strictly limited to the specifics of the disclosure, but rather, should be limited only to the extent of the following claims.

What is claimed is:

1. An exercise apparatus, comprising:

a frame having a base designed to rest upon a floor surface, and a vertical stanchion which extends upward from the base;

a user support mounted on the frame;

a pivot arm pivotally mounted on the stanchion;

a force receiving member;

a resistance device interconnected between the pivot arm and the frame; and a flexible connector interconnected between the force receiving member and the resistance device, wherein an end of the flexible connector is connected to the pivot arm, and the flexible connector is routed about at least one pulley, and the at least one pulley is selectively movable relative to the frame.

2. The exercise apparatus of claim 1, wherein the end of the flexible connector is selectively movable along the pivot arm.

3. The exercise apparatus of claim 1, wherein an additional pulley is rotatably mounted on the stanchion, and an intermediate portion of the flexible connector is routed about the additional pulley.

4. The exercise apparatus of claim 1, wherein the frame further includes a horizontal foot platform having left and right portions disposed on opposite sides of the user support, and each of the portions is sized and configured to support a respective foot of a person standing on the foot platform.

5. An exercise apparatus of claim 1, wherein the resistance device is a fluid cylinder.

6. An exercise apparatus, comprising:

a frame having a base designed to rest upon a floor surface;

a user support mounted on the frame;

a force receiving member;

a resistance device;

a flexible connector interconnected between the force receiving member and the resistance device, wherein the flexible connector is routed about at least one pulley, and the at least one pulley is selectively movable relative to the frame;

a second said force receiving member; and a second said flexible connector.

7. The exercise apparatus of claim 6, wherein the frame includes a vertical stanchion which extends upward from the base, and first and second pivot arms are pivotally mounted on the stanchion to pivot about a common rotational axis, and the resistance device is interconnected between the frame and at least one of the pivot arms, and an end of each said flexible connector is connected to a respective one of the pivot arms.

8. The exercise apparatus of claim 7, wherein the end of each said flexible connector is selectively movable along a respective one of the pivot arms.

9. The exercise apparatus of claim 7, wherein additional pulleys are rotatably mounted on the stanchion to rotate about a common rotational axis, and an intermediate portion of each flexible connector is routed about a respective one of the additional pulleys.

10. The exercise apparatus of claim 6, wherein the frame further includes a horizontal foot platform having left and right portions disposed on opposite sides of the user support, and each of the portions is sized and configured to support a respective foot of a person standing on the foot platform.

11. The exercise apparatus of claim 6, wherein the resistance deviceincludes a first telescoping member and a second telescoping member, and each said telescoping member is movably interconnected between the frame and a respective pivot arm, and each said pivot arm is pivotally mounted on the frame and connected to a respective flexible member.

12. An exercise apparatus, comprising:

a frame having a base designed to rest upon a floor surface, and a rail which is inclined relative to the floor surface;

a user support mounted on the frame;

a force receiving member;

a resistance device; and a flexible connector interconnected between the force receiving member and the resistance device, wherein the flexible connector is routed about at least one pulley, and the at least one pulley is movable along the rail.

13. The exercise apparatus of claim 12, wherein the frame includes a vertical stanchion which extends upward from the base, and a pivot arm is pivotally mounted on the stanchion, and the resistance device is interconnected between the pivot arm and the frame, and an end of the flexible connector is connected to the pivot arm.

14. The exercise apparatus of claim 13, wherein the end of the flexible connector is selectively movable along the pivot arm.

15. The exercise apparatus of claim 13, wherein an additional pulley is rotatably mounted on the stanchion, and an intermediate portion of the flexible connector is routed about the additional pulley.

16. The exercise apparatus of claim 12, wherein a second pulley is connected to the frame proximate a lower end of the rail.

17. The exercise apparatus of claim 16, wherein an additional pulley is rotatably mounted on the frame above the rail, and an intermediate portion of the flexible connector is routed about the additional pulley.

18. The exercise apparatus of claim 16, wherein the frame includes a vertical stanchion which extends upward from the base, and a pivot arm is pivotally mounted on the stanchion, and the resistance device is interconnected between the pivot arm and the frame, and an end of the flexible connector is connected to the pivot arm.

19. The exercise apparatus of claim 18, wherein the end of the flexible connector is selectively movable along the pivot arm.

20. The exercise apparatus of claim 18, wherein an additional pulley is rotatably mounted on the stanchion, and an intermediate portion of the flexible connector is routed about the additional pulley.

21. The exercise apparatus of claim 12, wherein the frame further includes a horizontal foot platform having left and right portions disposed on opposite sides of the user support, and each of the portions is sized and configured to support a respective foot of a person standing on the foot platform.

22. The exercise apparatus of claim 12, wherein the resistance device includes a telescoping member movbaly interconnected between the frame and a pivot arm that is pivotally mounted on the frame and connected to the flexible member.

23. The exercise apparatus of claim 12, further comprising a second said force receiving member; a second said flexible connector; a second said rail, wherein said at least one pulley includes a first pulley and a right first pulley, and each said first pulley is movable along a respective rail, and each said flexible connector is routed about a respective first pulley.

24. The exercise apparatus of claim 23, further comprising a left second pulley and a right second pulley, wherein each said second pulley is rotatably mounted on the frame proximate a lower end of a respective said rail, and each said flexible connector is routed about a respective second pulley.

25. The exercise apparatus of claim 24, further comprising a left third pulley and a right third pulley, wherein each said third pulley is rotatably mounted on the frame and rotates about a common rotational axis, and each said flexible connector is routed about a respective third pulley.

26. The exercise apparatus of claim 12, wherein an additional pulley is rotatably mounted on the frame above the rail, and an intermediate portion of the flexible connector is routed about the additional pulley.

27. An exercise apparatus, comprising:

a frame designed to rest upon a floor surface;

a user support mounted on the frame;

a force receiving member;

a resistance device;

a force transmitting member pivotally mounted on the frame; and a flexible connector interconnected between the force receiving member and the force transmitting member, wherein the flexible connector is selectively connected at any of several positions along the force transmitting member.

28. The exercise apparatus of claim 27, wherein the resistance device is interconnected between the force transmitting member and the frame, and an end of the flexible connector is connected to the force transmitting member.

29. The exercise apparatus of claim 28, wherein an additional pulley is rotatably mounted on the frame, and an intermediate portion of the flexible connector is routed about the additional pulley.

30. The exercise apparatus of claim 27, further comprising a second said force receiving member; a second said force transmitting member; and a second said flexible connector, wherein the at least one pulley includes a first pulley and a second pulley, and each said flexible connector is routed about a respective said pulley.

31. The exercise apparatus of claim 30, wherein additional pulleys are rotatably mounted on the frame to rotate about a common rotational axis, and an intermediate portion of each said flexible connector is routed about a respective one of the additional pulleys.

32. The exercise apparatus of claim 27, wherein the frame includes a rail that is inclined relative to the floor surface, and a pulley is movably mounted on the rail, and the flexible connector is routed about the pulley.

33. The exercise apparatus of claim 32, wherein a second pulley is connected to the frame proximate a lower end of the rail, and the flexible connector is also routed about the second pulley.

34. The exercise apparatus of claim 33, wherein a third pulley is rotatably mounted on the frame above the rail, and the flexible connector is also routed about the third pulley.

35. The exercise apparatus of claim 32, wherein the resistance device is interconnected between the force transmitting member and the frame, and an end of the flexible connector is connected to the force transmitting member.

36. The exercise apparatus of claim 27, wherein the flexible connector is routed about at least three pulleys on the frame, including a selectively movable pulley that is adjustably mounted on the frame and routes the flexible connector to the force receiving member, an intermediate pulley that is mounted on the frame proximate the floor surface, and a third pulley that is mounted on the frame above the movable pulley and the intermediate pulley and routes the flexible connector to the force transmitting member.

37. The exercise apparatus of claim 27, wherein the frame further includes a horizontal foot platform having left and right portions disposed on opposite sides of the user support, and each of the portions is sized and configured to support a respective foot of a person standing on the foot platform.

38. The exercise apparatus of claim 27, wherein the resistance device includes a telescoping member movably interconnected between the frame and the force transmitting member.

39. The exercise apparatus of claim 27, wherein the frame further includes a second rail, and the user support includes a bench that is mounted on the second rail.

40. The exercise apparatus of claim 39, wherein the bench includes a seat that is selectively movable along the second rail.

* * * * *